US006067734A

United States Patent [19]

Kallenberger

[11] Patent Number: 6,067,734

[45] Date of Patent: May 30, 2000

[54] DRAGLINE WALKING MECHANISM WITH IMPROVED PLANETARY TRANSMISSION

[75] Inventor: Harvey J. Kallenberger, Wind Lake, Wis.

[73] Assignee: Harnischfeger Technologies, Inc., Wilmington, Del.

[21] Appl. No.: 09/064,537

[22] Filed: Apr. 22, 1998

[51] Int. Cl.[7] ..... E02F 3/48

[52] U.S. Cl. ..... 37/395; 475/331

[58] Field of Search ..... 475/331, 338, 475/339, 340, 341, 342; 37/394, 395, 396, 397

[56] References Cited

U.S. PATENT DOCUMENTS 5,600,905 2/1997 Kallenberger .

*Primary Examiner*—Christopher J. Novosad

*Attorney, Agent, or Firm*—David R. Price; James Earl Lowe, Jr.

[57] ABSTRACT

A dragline comprising a main housing, a moving mechanism for moving the main housing over the ground, and a planetary transmission driving the moving mechanism, the planetary transmission including a transmission housing, a sun gear, a ring gear and planet gears centered on a center axis, the planet gears meshing with the ring gear and the sun gear so that the planet gears rotate about the center axis, the planet gears drivingly connected to a carrier, the carrier including a low-friction coating on a carrier annular surface and a carrier cylindrical surface, the low-friction coating reducing friction between the carrier and the transmission housing.

11 Claims, 8 Drawing Sheets

10
12
16
38
31
30
36
40
22
20
18
85
312
362
346
394
382

16
36
358
362
346
394
166
114
90
88
82
192
6
40
41
42
104
120
85
152
210
276
80
312
322
61
382

DRAGLINE WALKING MECHANISM WITH IMPROVED PLANETARY TRANSMISSION

BACKGROUND OF THE INVENTION

1. Field of the Invention

The invention relates to a planetary transmission in the walking mechanism of a dragline.

2. Discussion of Prior Art

A walking dragline typically includes a main housing and a boom which extends upwardly and outwardly from the main housing and has thereon a sheave for supporting a hoist rope. The hoist rope extends from a bucket hoist mechanism and over the sheave to a bucket for causing vertical movement of the bucket. A drag rope extends between a bucket drag mechanism and the bucket for causing horizontal movement of the bucket. The main housing is supported by a tub that sits on the ground when the dragline is engaged in digging operations. A pair of walking mechanisms are mounted on the opposite sides of the main housing and are operable for moving the main housing over the ground between digging operations.

U.S. Pat. No. 5,600,905, which is assigned to the assignee hereof and which is incorporated herein by reference, discloses a planetary transmission for driving the walking mechanism of a dragline. The planetary transmission is coupled to a motor output mechanism such as a shaft. The planetary transmission reduces the speed of the shaft, causing an increase in torque. A planetary transmission ordinarily includes a sun gear, a ring gear, planet gears which mesh with both the sun gear and the ring gear, and a carrier which is connected to and moves with the planet gears. In the transmission of U.S. Pat. No. 5,600,905, the sun gear is driven through a parallel shaft gear set by the motor output shaft, and the output carrier is drivingly connected to the walking mechanism.

SUMMARY OF THE INVENTION

The invention provides an improved planetary transmission. In some known planetary transmissions, a problem exists because at some operating loads the internal planetary gear assembly tends to drop downwards. This causes the weight of the planetary gear assembly to be supported by housing and carrier surfaces. Interaction between these surfaces leads to the generation of wear particles within the gearbox even though these surfaces are submersed in lubricant. The wear particles so produced can circulate within the gearbox via the lubricant and cause wear and additional particles to be generated between other moving components. This leads to a shortened life for all components and a necessity of repair or replacement. To solve this problem, the planetary transmission of the present invention includes a low-friction coating on one or more surfaces that may come into contact with each other.

Specifically, the invention provides a planetary transmission of the type described above. The housing includes a housing annular surface which is perpendicular to and centered on the center axis, and a housing cylindrical surface which is centered on its center axis. The carrier includes a carrier annular surface and a carrier cylindrical surface which face the housing annular surface and the housing cylindrical surface, respectively. The carrier annular surface is perpendicular to and centered on its center axis. The carrier cylindrical surface is centered on the center axis.

The planetary transmission further includes a low-friction coating on at least one of the housing annular surface, the housing cylindrical surface, the carrier annular surface, and the carrier cylindrical surface. The low-friction coating reduces the friction between the carrier and the housing. In the preferred embodiment, both the carrier annular surface and the carrier cylindrical surface are coated with the low-friction and wear coating. Alternatively, any of the four surfaces, alone or in combination, may be coated. For example, the housing annular surface and the housing cylindrical surface may be coated, the housing annular surface and the carrier cylindrical surface may be coated, the carrier annular surface and the housing cylindrical surface may be coated, or all four surfaces may be coated. The low-friction coating may be cast, mechanically attached, brazed, or preferably arc welded to the surface or surfaces. Preferably, the low-friction coating is a non-ferrous material, most preferably a non-ferrous bronze alloy.

Figure 1:
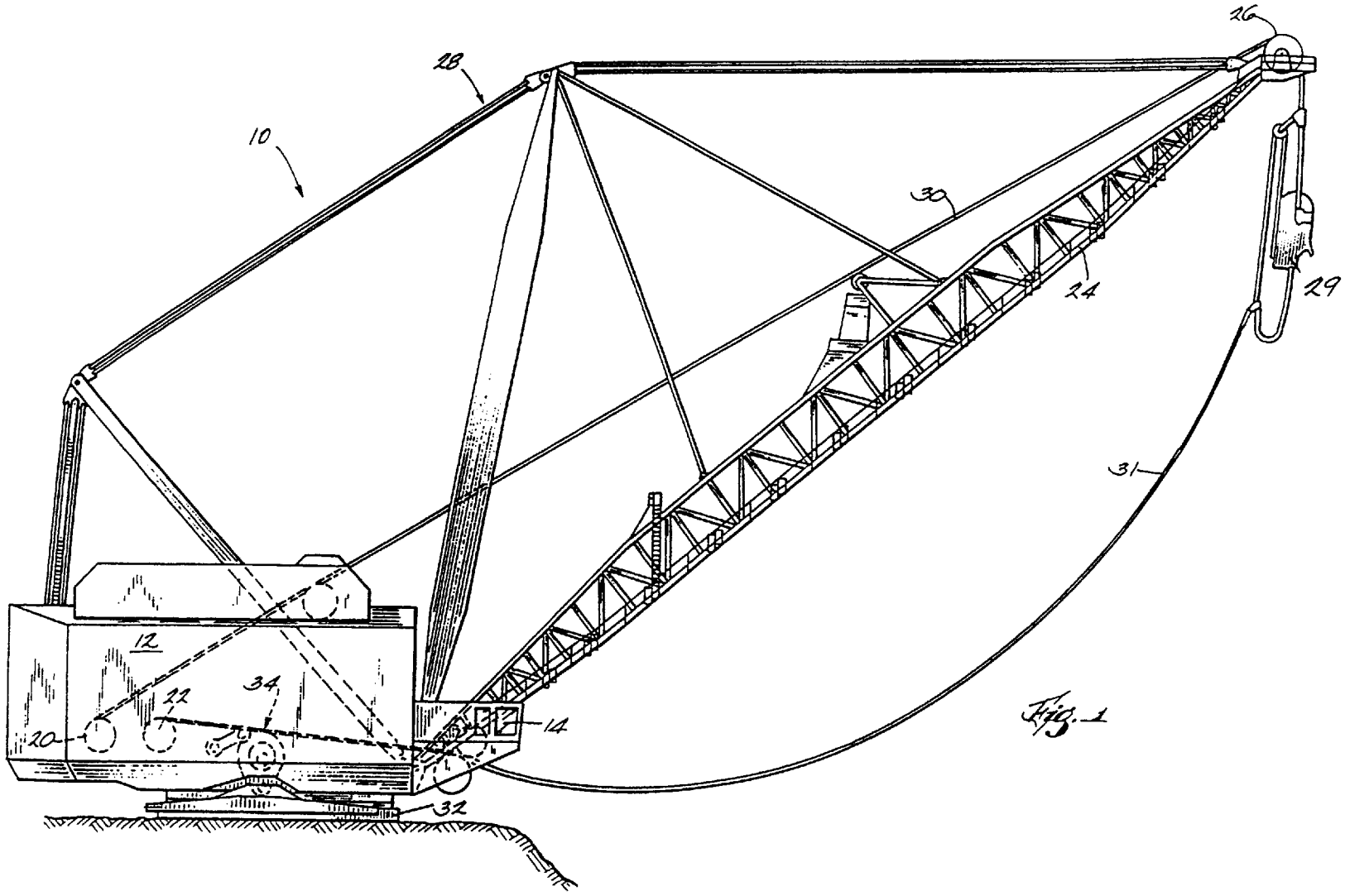
FIG. 1 is a side elevational view of a dragline embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
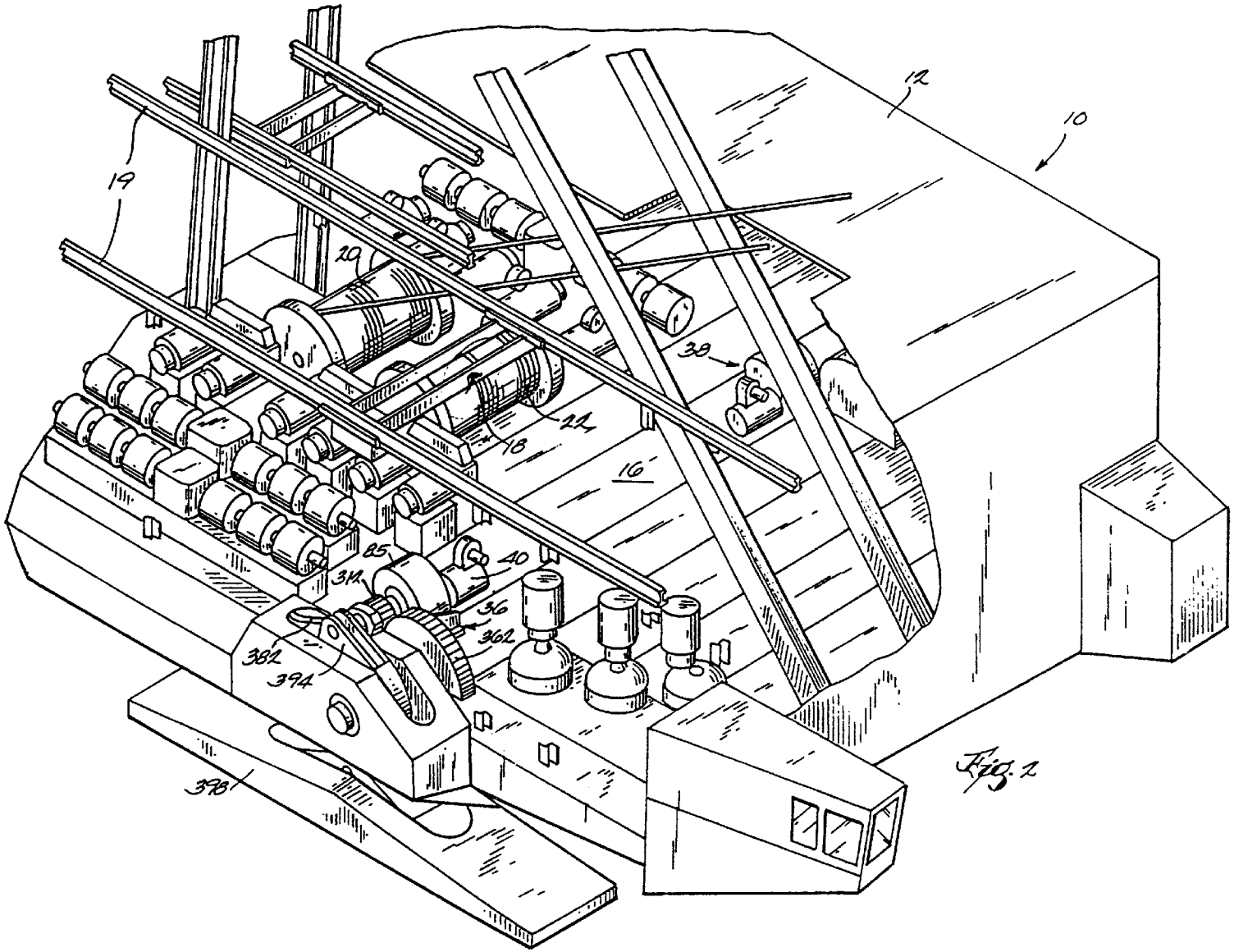
FIG. 2 is a partial perspective view of the main housing.
Figure 3:
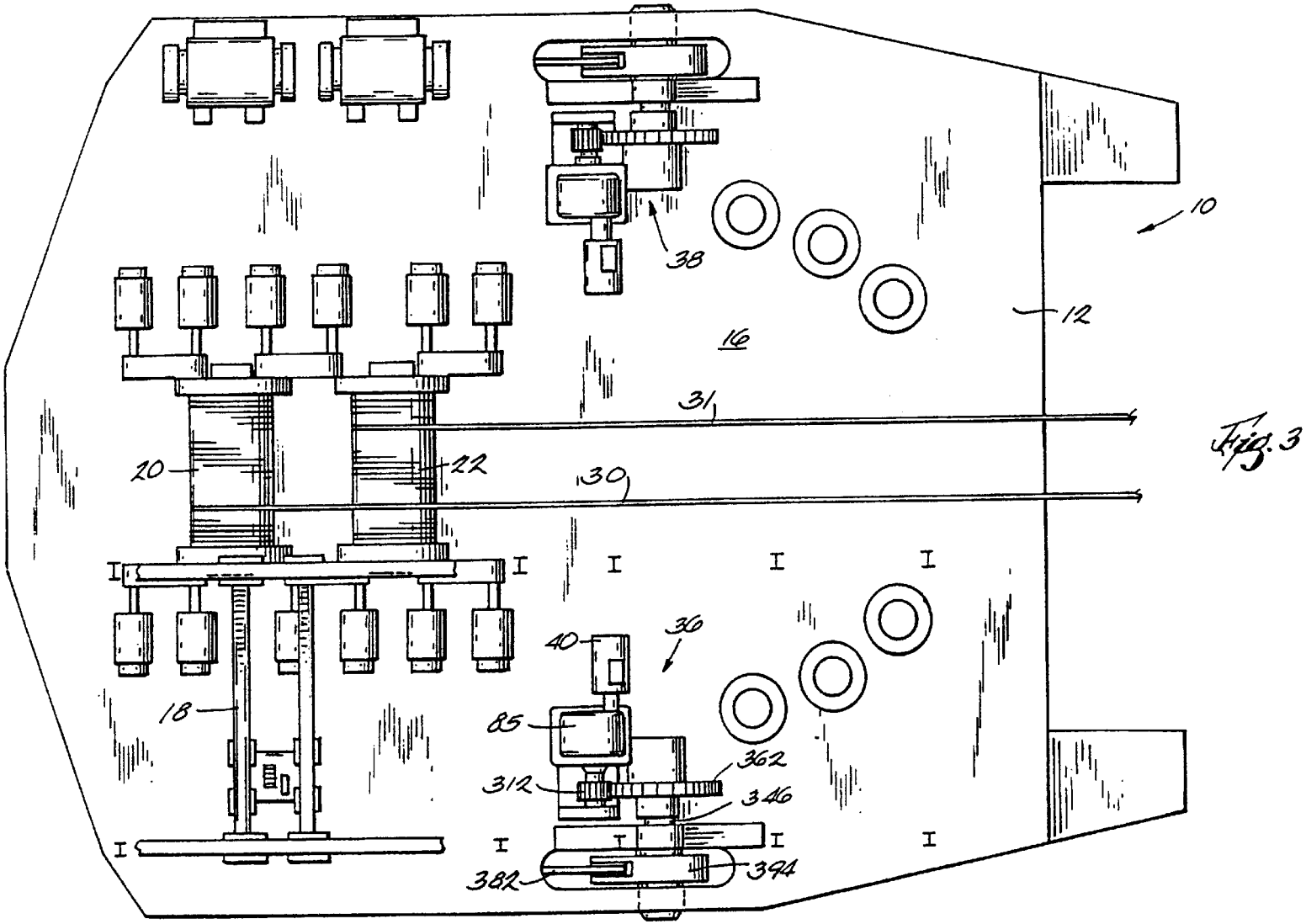
FIG. 3 is a partial top plan view of the main housing.
Figure 4:
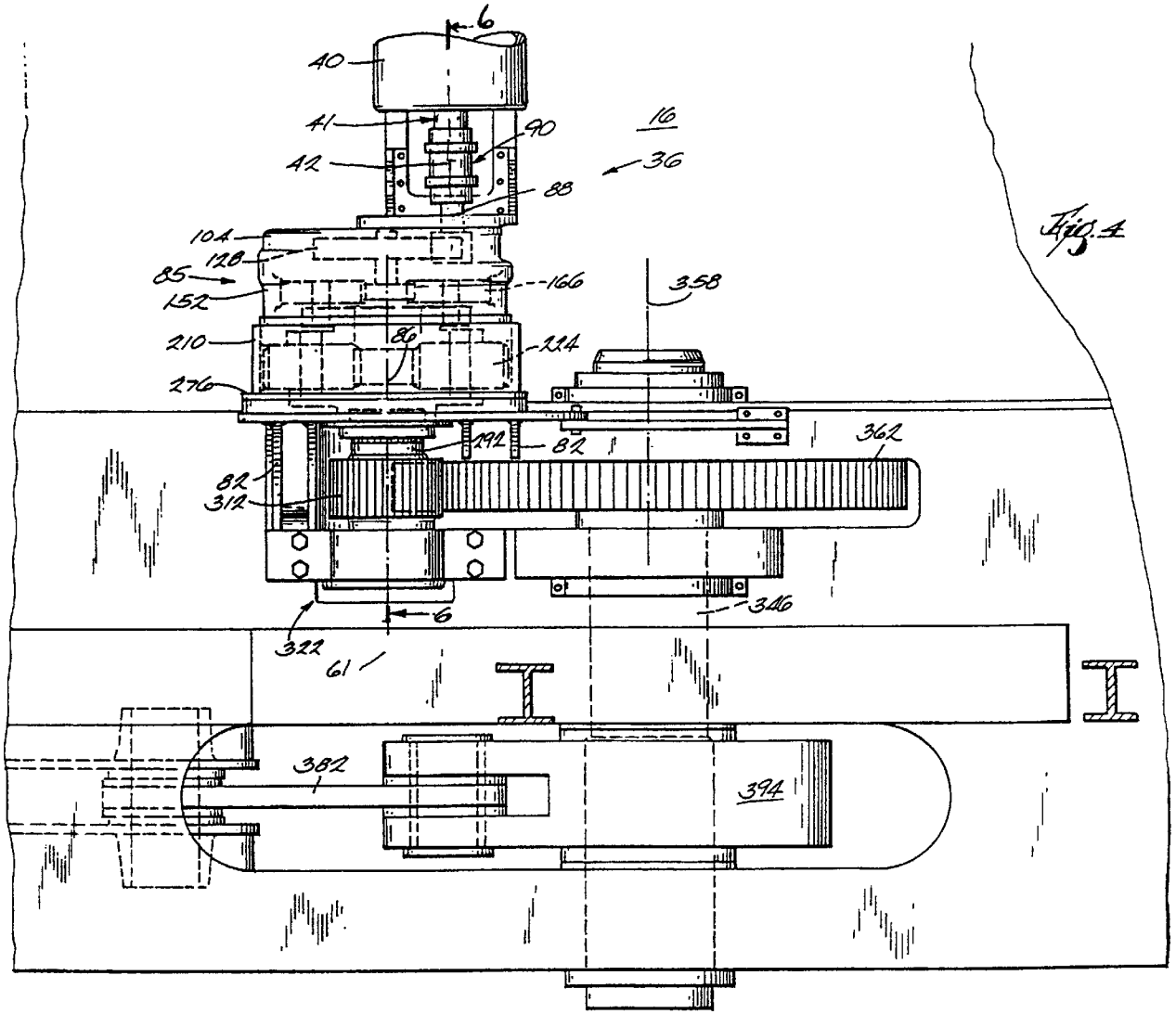
FIG. 4 is an enlarged portion of FIG. 3.
Figure 5:
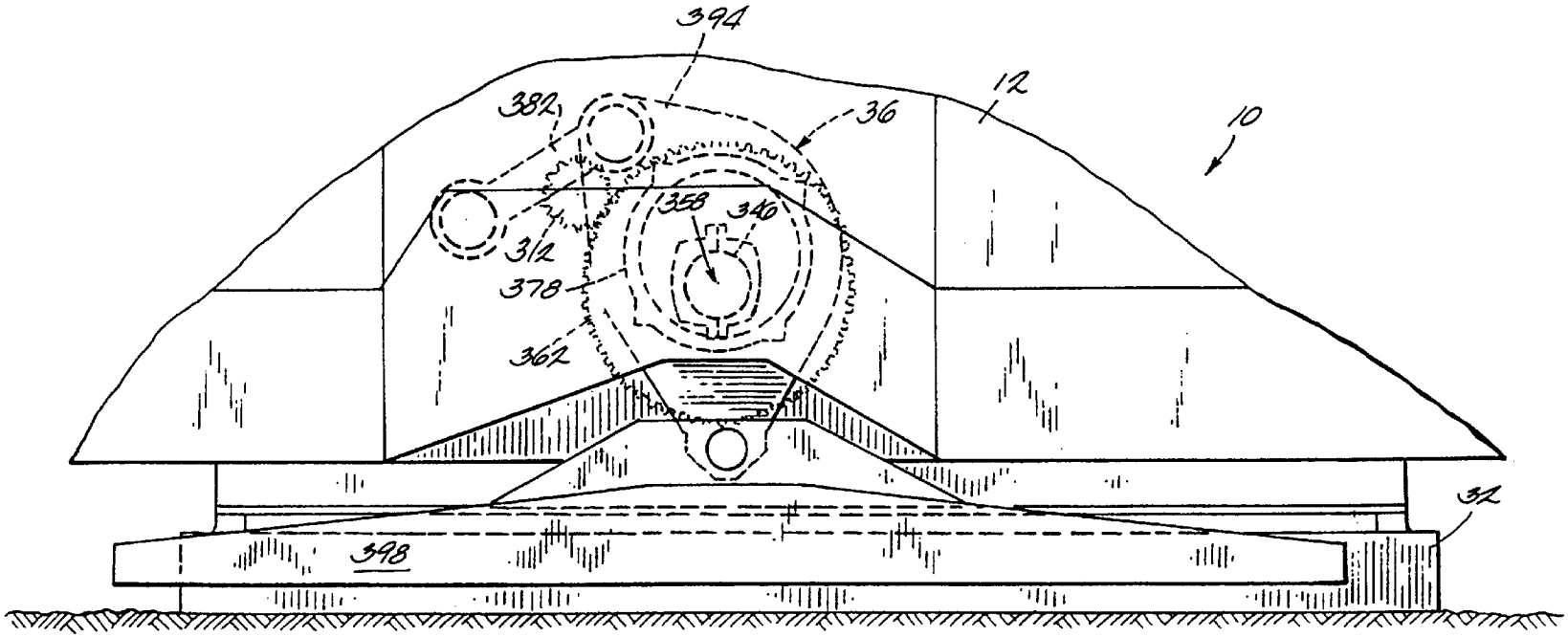
FIG. 5 is an enlarged portion of FIG. 1.

A dragline 10 embodying the invention is illustrated in the drawings, but the invention is applicable to any device which uses a horizontal transmission where gravity applies a force on the internal planetary gear assemblies. The dragline 10 comprises (FIG. 1) a main housing 12 including an operator's cab 14. The main housing 12 also includes (FIGS. 2–6) an upwardly facing deck or main housing floor 16. The main housing 12 also includes (FIGS. 2 and 3) a lifting apparatus 18 which is supported by a crane runway 19 above the main housing floor 16 for lifting and moving components above the main housing floor 16 for repair and maintenance. In the illustrated embodiment, the lifting apparatus 18 comprises a pair (one shown in FIG. 3) of overhead cranes on the opposite sides of the main housing 12. The dragline 10 also includes (FIGS. 1–3) a bucket hoist mechanism 20 and a bucket drag mechanism 22, both of which are mounted on the main housing floor 16. Referring to FIG. 1, a boom 24 extends upwardly and outwardly from the main housing 12. The upper end of the boom 24 has thereon a sheave 26. The boom 24 is supported relative to the main housing 12 by conventional supporting structure 28. The dragline 10 also includes a bucket 29, a hoist rope 30 extending between the bucket hoist mechanism 20 and the bucket 29 and over the sheave 26 for causing vertical movement of the bucket 29, and a drag rope 31 extending between the bucket drag mechanism 22 and the bucket 29 for causing horizontal movement of the bucket 29. The dragline 10 further includes (FIGS. 1 and 5) a tub 32 which sits on the ground and thus supports the main housing 12 during digging operations. The dragline 10 also includes (shown best in FIGS. 1–5) a moving mechanism 34, further described below, which moves the main housing 12 over the ground between digging operations.

In the illustrated embodiment (FIGS. 1–3 and 5), the moving mechanism 34 comprises a pair of walking mechanisms 36 and 38. Except as described below, the walking mechanisms 36 and 38 are identical to those described in U.S. Pat. No. 5,600,905. In another embodiment (not shown) the moving mechanism can be another mechanism, such as a set of crawler tracks, which is suitable for moving the dragline over the ground. When operated in unison, the walking mechanisms 36 and 38 lift the main housing 12 and tub 32 and move them a short distance. In the specific embodiment illustrated, the walking mechanisms 36 and 38 move the main housing about seven feet in each so-called "step". The walking mechanisms 36 and 38 are mirror images, and only the walking mechanism 36 will be described in further detail.

The walking mechanism 36 includes (FIGS. 2–4 and 6) a motor 40. In the illustrated embodiment, the motor 40 is an electric motor. In another embodiment (not shown), the motor can be an internal combustion engine. The motor 40 includes an output shaft 41. The output shaft 41 is rotatable about a generally horizontal axis. The motor 40 is fixed to the main housing floor 16.

The walking mechanism 36 includes (FIGS. 2–7) a planetary transmission 85. The transmission 85 is mounted on the main housing floor 16 in the manner described in U.S. Pat. No. 5,600,905. The transmission 85 has (FIGS. 3–4 and 6–7) a generally horizontal center axis 86 coaxial with the axis 61 of pinion 312. The transmission 85 includes an input shaft 88 which is generally coaxial with the motor output shaft 41 and which is rotatable about the axis 42. A spacer coupling 90 releasably and drivingly connects the motor output shaft 41 to the transmission input shaft 88.

The transmission 85 includes (FIGS. 6–7) a fluid-tight transmission housing 102. The housing 102 includes an input end housing 104 which supports (FIG. 6) inner and outer bearings 108 and 110 which in turn rotatably support the transmission input shaft 88. A sealing cap 112 (FIGS. 6–7) surrounds the transmission input shaft 88 and is fixed to the input end housing 104 by suitable means such as bolts or screws. Other components of the housing will be described below.

The transmission 85 includes (FIGS. 4 and 6–7) an input pinion 122 fixed to the input shaft 88 for common rotation therewith about the axis 42. The input pinion 122 can either be integral with the input shaft 88 or be fixed to the input shaft 88 such as by splines.

Figure 6:
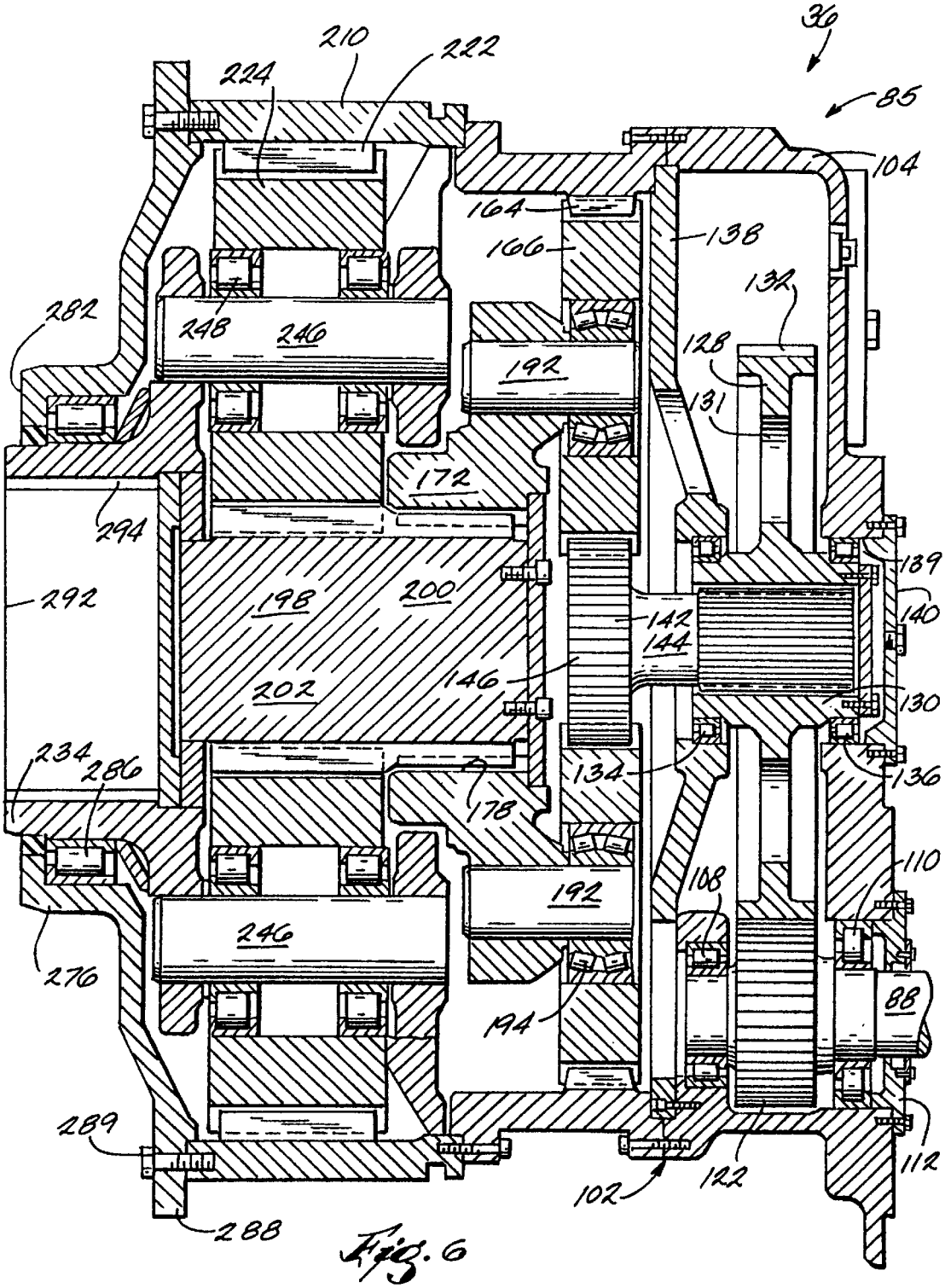
FIG. 6 is a view taken generally along line 6—6 in FIG. 4, with parts removed for clarity.
Figure 7:
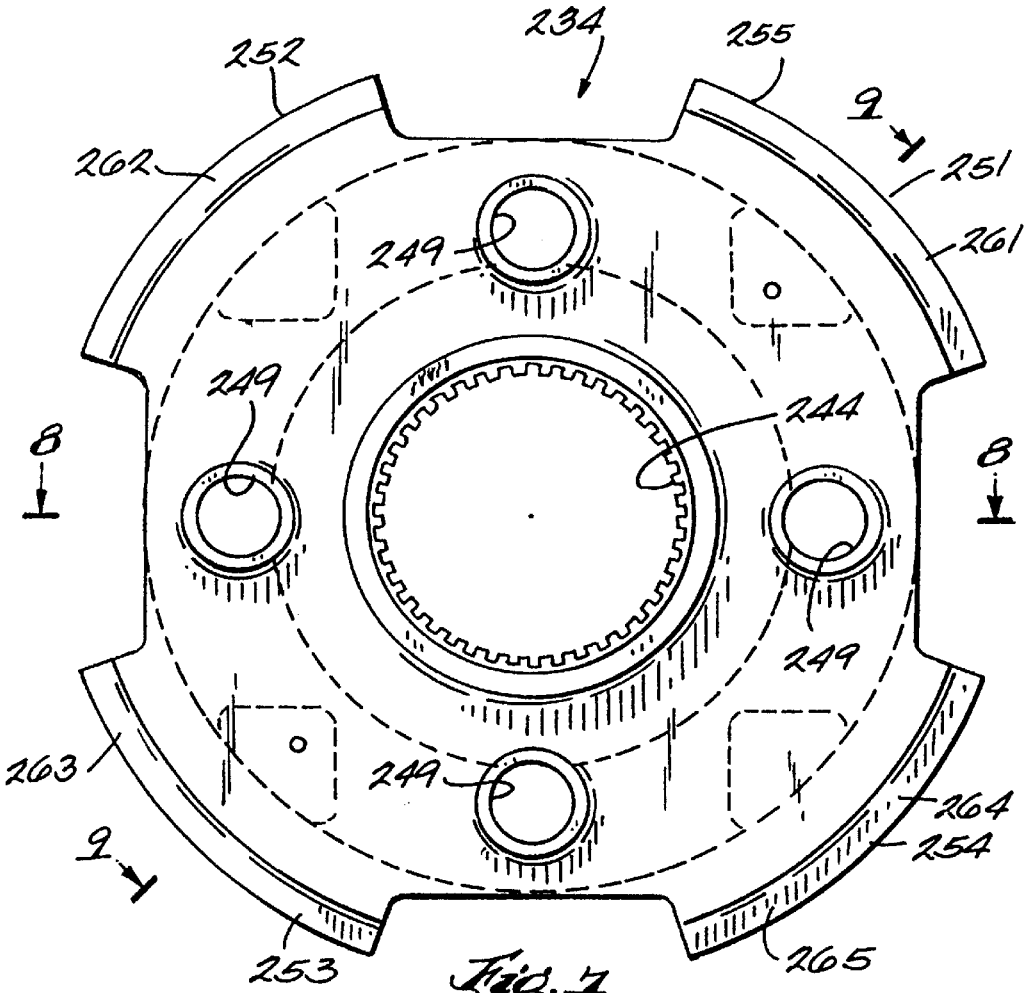
FIG. 7 is a view of the carrier taken along line 7—7 in FIG. 6.

The transmission 85 also includes a reduction gear 128 supported for rotation about the center axis 86. The reduction gear 128 includes (FIG. 6) a central hub portion 130, a web 131 extending radially outwardly from the hub portion 130, and gear teeth 132 extending radially outwardly from the web 131. The hub portion 130 is rotatably supported by inner and outer bearings 134 and 136 (FIG. 6). The inner bearing 134 is supported by a bearing support member 138, and the outer bearing 136 is seated in a bore 139 in the input end housing 104. The bearing support member 138 is fixed to the input end housing 104 by suitable means such as bolts or screws. A sealing cap 140 closes the bore 139 in the input end housing 104.

The transmission 85 includes (FIGS. 4 and 6–7) a first sun gear 142. The sun gear 142 includes a shaft portion 144 spline fit to the hub of the reduction gear 128. The sun gear 142 thus is fixed to the reduction gear 128 for common rotation therewith about the center axis 86. The sun gear 142 also includes a toothed portion 146 which is integral with the shaft portion 144.

The transmission 85 includes (FIGS. 6–7) a first ring gear 152 that is also part of the transmission housing 102. The ring gear 152 is fixed to the input end housing 104 by suitable means such as bolts or screws. The ring gear 152 includes radially inwardly extending gear teeth 164. The ring gear 152 is centered on the center axis 86. The ring gear 152 includes a housing annular surface 165 which is generally perpendicular to and centered on the center axis.

The transmission 85 includes (FIGS. 6–7) two or more identical first planet gears 166 (two shown). The planet gears 166 are spaced equidistant from one another about the sun gear 142. Each planet gear 166 meshes with the sun gear 142 via carrier 172 and with the ring gear teeth 164. The planet gears 166 thus are driven by the sun gear 142 and revolve around the sun gear 142 and the center axis 86.

The transmission 85 includes (FIGS. 6–7) a first carrier 172. The carrier 172 has a central bore 178 which extends horizontally and which is approximately centered on the center axis 86. Each of the planet gears 166 is drivingly connected to the carrier 172 by a respective pin 192. Each pin 192 supports a bearing 194 (FIG. 6) which in turn rotatably supports the respective planet gear 166. Each pin 192 is housed in and extends from a respective bore in the carrier 172. The carrier 172 thus is connected to the planet gears 166 by the pins 192 such that revolution of the planet gears 166 around the center axis 86 causes rotation of the carrier 172 about the center axis 86.

The transmission 85 includes (FIGS. 6–7) a second sun gear 198. The sun gear 198 includes a shaft portion 200 which is housed in the carrier bore 178 and which is spline fit to the carrier 172. The sun gear 198 thus is fixed to the carrier 172 for common rotation therewith about the center axis 86. The sun gear 198 also includes a toothed portion 202 which is integral with the shaft portion 200.

The transmission 85 includes (FIGS. 4 and 6–7) a second ring gear 210 that is also part of the transmission housing 102. The second ring gear 210 is fixed to the first ring gear 152 by suitable means such as bolts or screws (not shown). The ring gear 210 includes (FIGS. 6–7) radially inwardly extending gear teeth 222. The ring gear 210 is centered on the center axis 86. The ring gear 210 includes a housing cylindrical surface 223 which is centered on the center axis.

The transmission 85 includes (FIGS. 4 and 6–7) two or more identical second planet gears 224 (two shown). The planet gears 224 are spaced equidistant from one another about the sun gear 198 via carrier 234. Each planet gear 224 meshes with the sun gear 198 and with the ring gear teeth 222. The planet gears 224 thus are driven by the second sun gear 198 and revolve around the second sun gear 198 and the center axis 86.

Figure 8:
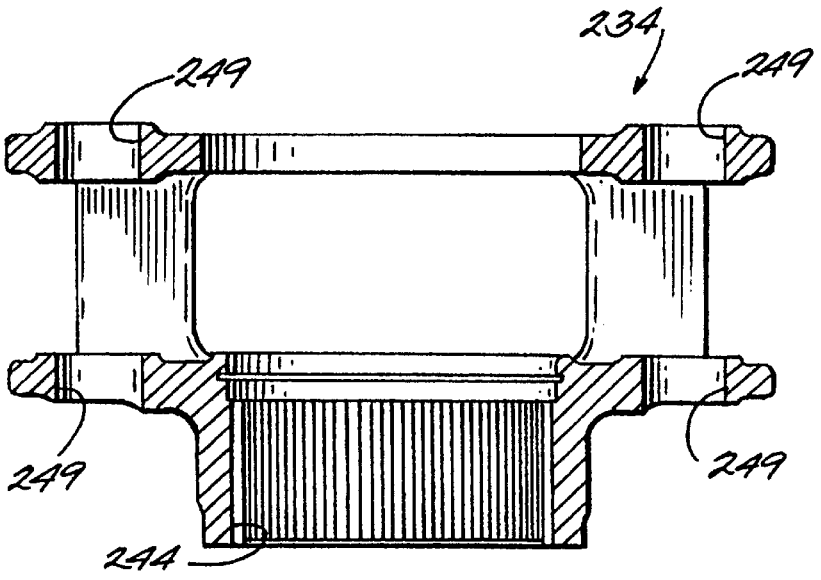
FIG. 8 is a view taken generally along line 8—8 in FIG. 7.
Figure 9:
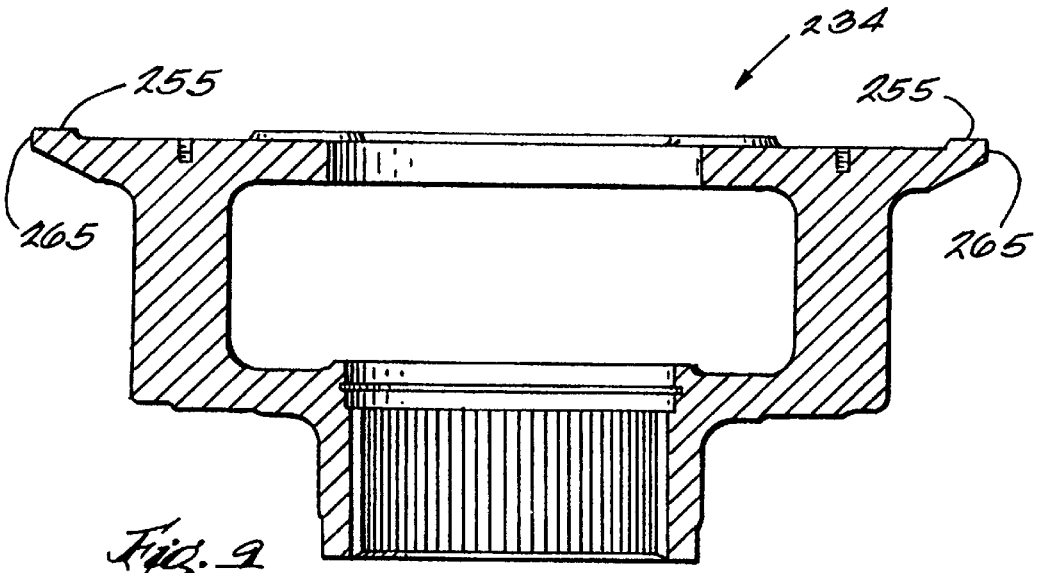
FIG. 9 is a view taken generally along line 9—9 in FIG. 7.
Figure 10:
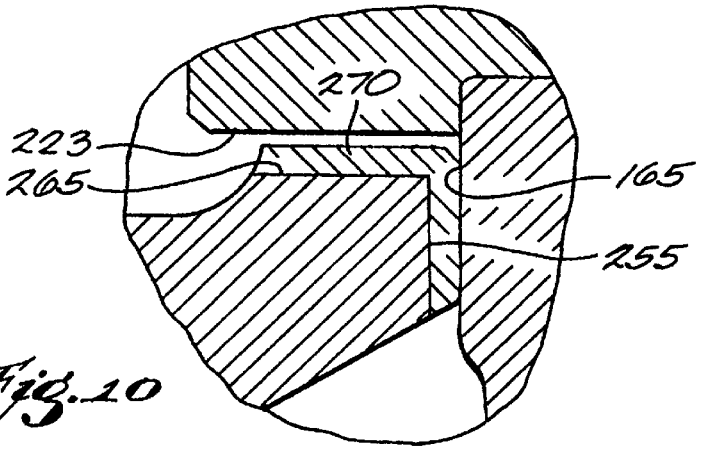
FIG. 10 is an enlarged portion of FIG. 6 showing surfaces coated with low-friction coating.

The transmission 85 includes (FIGS. 6–7) a second carrier 234. The carrier 234 has a central bore 244 which extends horizontally and which is approximately centered on the center axis 86. Each of the planet gears 224 is drivingly connected to the carrier 234 by a respective pin 246. Each pin 246 supports bearings 248 which in turn rotatably support the respective planet gear 224. Each pin 246 is housed in a respective pair of spaced bores 249 (FIG. 8) in the carrier 234. The carrier 234 thus is connected to the planet gears 224 by the pins 246 such that revolution of the planet gears 224 around the center axis 86 causes rotation of the carrier 234 about the center axis 86.

The carrier 234 includes arcuate, annular surface portions 251, 252, 253 and 254 which define a carrier annular surface 255 which is generally perpendicular to and centered on the center axis and which faces the housing annular surface 165. In the illustrated construction, the annular surface portions 251, 252, 253 and 254 are spaced in between the planet gears. The carrier 234 also includes arcuate, cylindrical surface portions 261, 262, 263 and 264 which define a carrier cylindrical surface 265 which is centered on the center axis and which faces the housing cylindrical surface 223. In the illustrated construction, the cylindrical portions 261, 262, 263 and 264 are spaced in between the planet gears and are coextensive with the annular portions 251, 252, 253 and 254. In an alternative construction, either of the annular portions and the cylindrical portions could be continuous.

The carrier also includes a low-friction coating 270 on the carrier annular surface 255 and on the carrier cylindrical surface 265. The low-friction coating 270 reduces the friction between the carrier 234 and the housing 102. The low-friction coating 270 may be further characterized as having mechanical properties such that the coefficient of friction between the low-friction coating 270 and a base housing or carrier material is less than the existing coefficient of friction between the base housing and carrier material. Reduction of friction between the carrier and the housing substantially prevents the generation of heat and wear particles which may damage other moving components. Preferably, the low-friction coating 270 is a non-ferrous material, most preferably a non-ferrous bronze alloy. In other embodiments, non-metallic bushing materials, such as plastics and composite materials, often used in journal bearings or linear motion slide mechanisms, can be used. The low-friction coating may be brazed, mechanically attached, cast, or preferably arc welded to the carrier cylindrical surface and to the carrier annular surface.

Figure 11:
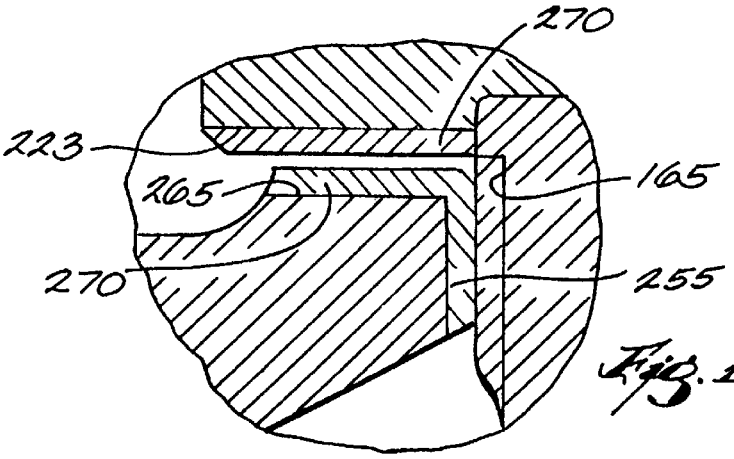
FIG. 11 is a view similar to FIG. 10 showing an alternative construction.

In alternative constructions, any of the four surfaces 165, 223, 255 and 265, alone or in combination, may be coated. Preferably, at least one of the facing surfaces 165 and 255 and at least one of the facing surfaces 223 and 265 is coated. FIG. 11 illustrates an alternative construction in which all four surfaces are coated.

The transmission 85 includes (FIGS. 4 and 6–7) a pilot member 276 that is also part of the transmission housing 102. The pilot member 276 includes an annular projection 282 which surrounds the carrier 234. The annular projection 282 supports (FIGS. 6–7) a bearing 286 which in turn rotatably supports the output end of the carrier 234. The pilot member 276 also includes an annular flange 288 which extends radially outwardly from the annular projection 282. The annular flange 288 is fixed to the ring gear 210 by a set of circumferentially spaced bolts 289.

Thus, the input end housing 104, first ring gear 152, second ring gear 210 and pilot member 276 together comprise the housing 102 of the transmission 85. While these components are separate in the illustrated construction, combinations of them could also be unitary. The housing 102 contains lubrication fluid in which the internal components of the transmission 85 are immersed. The components of the transmission 85 thus are not exposed for external lubrication.

The walking mechanism 36 includes (FIGS. 3–4 and 6–8) an output shaft 292 which is centered on the center axis 61. The output shaft 292 includes (FIGS. 4 and 6) opposite inner and outer or right and left ends. The inner or right end (FIGS. 6 and 7) extends into the carrier bore 244. In the illustrated construction, the shaft 292 is spline fit at 294 to the carrier 234. The output shaft 292 thus is fixed to the carrier 234 for common rotation therewith about the center axis 86.

The walking mechanism 36 includes (FIGS. 2–6) an output pinion 312. The output pinion 312 is fixed to the output shaft 292 intermediate the ends for common rotation therewith about the center axis 61. The output pinion 312 can either be integral with the output shaft 292 or be fixed to the output shaft 292 such as by splines. The manner in which the output pinion 312 is supported is described in U.S. Pat. No. 5,600,905.

The components of the walking mechanism 36 as hereinafter described are as set forth in detail in U.S. Pat. No. 5,245,882, which is hereby incorporated by reference.

The walking mechanism 36 also includes (FIGS. 4 and 8) a main walk shaft 346. The main walk shaft 346 is rotatably supported on the main housing 12 for rotation about a generally horizontal axis 358. A driven gear 362 (FIGS. 2–5 and 8) is fixed to the main walk shaft 346 for common rotation therewith about the axis 358 such as by splines. The driven gear 362 thus is rotatably supported by the main housing 12 for rotation relative thereto about the axis 358. The driven gear 362 meshes with and is driven by the output pinion 312.

The walking mechanism 36 includes (FIG. 5) a driven eccentric which is fixed to the main walk shaft 346 for common rotation therewith about the axis 358. The driven eccentric thus is driven by the driven gear 362 and is supported by the main walk shaft 346 in the main housing 12 for rotation relative thereto about the axis 358.

The walking mechanism 36 includes (FIGS. 4 and 5) a knee link 382. One end of the knee link 382 is pivotally connected to the main housing 12. A walk leg housing 394 is connected to the other end of the knee link 382 and to the driven eccentric such that rotation of the driven eccentric causes walking movement of the lower end of the walk leg housing 394.

The walking mechanism 36 also includes (FIGS. 1–2 and 5) a shoe 398. The shoe 398 is fixed to the lower end of the walk leg housing 394 for engaging the ground during walking movement of the walk leg housing 394.

In operation of the walking mechanism 36 to move the main housing 12 across the ground, the motor 40 is operated to cause rotation of the motor output shaft 41 and thus drive the transmission input shaft 88. The input pinion 122 rotates in common with the input shaft 88 and drives the reduction gear 128. The sun gear 142 rotates in common with the reduction gear 128 and drives the planet gears 166 to revolve around the sun gear 142 and inside the ring gear 152. The planet gears 166 are connected to the carrier 172 via the pins 192 and thus drive the carrier 172. The sun gear 198 rotates in common with the carrier 172 and drives the planet gears 224 to revolve around the sun gear 198 and inside the ring gear 210. The planet gears 224 are connected to the carrier 234 via the pins 246 and thus drive the carrier 234. The output shaft 292 rotates in common with the carrier 234. The output pinion 312 rotates in common with the output shaft 292 and drives the driven gear 362. The driven gear 362 is fixed to output shaft 392 and drives the main walk shaft 346 and thus drives the driven eccentric. Rotation of the driven eccentric causes walking movement of the lower end of the walk leg housing 394. The shoe 398 moves with the lower end of the walk leg housing 394 and engages the ground for lifting and moving the main housing 12.

Various features of the invention are set forth in the following claims.

What is claimed is:

1. A planetary transmission comprising a housing having a center axis and including a housing annular surface and a housing cylindrical surface, the housing annular surface being generally perpendicular to and centered on the center axis, and the housing cylindrical surface being centered on the center axis, a sun gear which is supported within the housing and which is rotatable about the center axis, a plurality of planet gears supported within the housing, each of the planet gears meshing with the sun gear, a ring gear which is supported within the housing and which meshes with the planet gears so that the planet gears mesh with and move within the ring gear and around the sun gear, a carrier connected to the planet gears so that the carrier rotates about the center axis as the planet gears move around the sun gear, the carrier including a carrier annular surface and a carrier cylindrical surface, the carrier annular surface facing the housing annular surface and being generally perpendicular to and centered on the center axis, and the carrier cylindrical surface facing the housing cylindrical surface and being centered on the center axis, and a low-friction coating on at least one of the housing annular surface, the housing cylindrical surface, the carrier annular surface, and the carrier cylindrical surface.

2. The planetary transmission of claim 1 wherein the low-friction coating is cast, mechanically attached, arc welded or brazed to the one of the housing annular surface, the housing cylindrical surface, the carrier annular surface, and the carrier cylindrical surface.

3. The planetary transmission of claim 1 wherein the low-friction coating is arc welded to the one of the housing annular surface, the housing cylindrical surface, the carrier annular surface, and the carrier cylindrical surface.

4. The planetary transmission of claim 1 wherein the carrier annular surface and the carrier cylindrical surface are coated with the low-friction coating.

5. The planetary transmission of claim 1 wherein the housing annular surface and the housing cylindrical surface are coated with the low-friction coating.

6. The planetary transmission of claim 1 wherein the ring gear and housing are unitary.

7. The planetary transmission of claim 1 wherein the low-friction coating reduces friction between the carrier and the housing.

8. The planetary transmission of claim 1 wherein the low-friction coating is non-ferrous.

9. The planetary transmission of claim 8 wherein the non-ferrous low-friction coating is a bronze alloy.

10. A planetary transmission comprising a housing having a center axis and including a housing annular surface and a housing cylindrical surface, the housing annular surface being generally perpendicular to and centered on the center axis, and the housing cylindrical surface being centered on the center axis, a sun gear which is supported within the housing and which is rotatable about the center axis, a plurality of planet gears supported within the housing, each of the planetary gears meshing with the sun gear, a ring gear which is supported within the housing and which meshes with the planet gears so that the planet gears mesh with and move within the ring gear and around the sun gear, a carrier connected to the planet gears so that the carrier rotates about the center axis as the planetary gears move around the sun gear, the carrier including a carrier annular surface and a carrier cylindrical surface, the carrier annular surface facing the housing annular surface and being generally perpendicular to and centered on the center axis, and the carrier cylindrical surface facing the housing cylindrical surface and being centered on the center axis, and a low-friction nonferrous coating arc welded to the carrier annular surface and the carrier cylindrical surface.

11. A dragline comprising a main housing, a bucket hoist mechanism mounted on the main housing, a bucket drag mechanism mounted on the main housing, a boom extending from the main housing, the boom having an outer end, a sheave mounted on boom adjacent the outer end of the boom, a bucket, a hoist rope extending between the bucket and the bucket hoist mechanism and over the sheave for causing vertical movement of the bucket, a drag rope extending between the bucket and the bucket drag mechanism for causing horizontal movement of the bucket, and a moving mechanism for moving the main housing over the ground, the moving mechanism including a motor mounted on the main housing, the motor including a motor output shaft rotatable about a generally horizontal axis, a planetary transmission mounted in the main housing, the transmission including a transmission housing having a center axis, the transmission housing including a cylindrical surface centered on the center axis and an annular surface centered on and perpendicular to the center axis, an input shaft releasably coupled to and driven by the motor output shaft, a reduction gear which is driven by the transmission input shaft and which is rotatable about the center axis, a sun gear which is driven by the reduction gear and which is rotatable about the center axis, a plurality of planet gears, each of the planet gears meshing with and being driven by the sun gear, a ring gear which is supported within the housing and which meshes with the planet gears so that the planet gears mesh with and move within the ring gear and around the sun gear, and a carrier connected to the planetary gears so that the carrier rotates about the center axis in response to movement of the planet gears around the sun gear, the carrier including a carrier cylindrical surface and a carrier annular surface, the carrier annular surface being generally perpendicular to and centered on the center axis, and the carrier cylindrical surface being centered on the center axis, the carrier cylindrical surface facing the housing cylindrical surface and the carrier annular surface facing the housing annular surface, a low-friction coating on at least one of the housing annular surface, the housing cylindrical surface, the carrier annular surface, and the carrier cylindrical surface, and an output shaft which is rotatable about the center axis and which is driven by the carrier.

* * * * *